US007664438B2

(12) United States Patent
Hirakawa

(10) Patent No.: US 7,664,438 B2
(45) Date of Patent: Feb. 16, 2010

(54) DEVELOPING DEVICE, IMAGE FORMING APPARATUS AND DEVELOPING METHOD

(75) Inventor: Hiroyuki Hirakawa, Nara (JP)

(73) Assignee: Sharp Kabushiki Kaisha, Osaka-Shi (JP)

( * ) Notice: Subject to any disclaimer, the term of this patent is extended or adjusted under 35 U.S.C. 154(b) by 270 days.

(21) Appl. No.: 11/472,872

(22) Filed: Jun. 21, 2006

(65) Prior Publication Data

US 2007/0159660 A1 Jul. 12, 2007

(30) Foreign Application Priority Data

Jun. 21, 2005 (JP) ..... 2005-180798

(51) Int. Cl.
*G03G 15/08* (2006.01)

(52) U.S. Cl. ..... 399/258

(58) Field of Classification Search ..... 399/30, 399/58, 61, 62, 255, 258, 222
See application file for complete search history.

(56) References Cited

U.S. PATENT DOCUMENTS 5,619,312 A 4/1997 Hatano et al.
2004/0156648 A1 * 8/2004 Miyasaka et al. ..... 399/62

FOREIGN PATENT DOCUMENTS

JP 01-172879 7/1989
JP 05-333700 12/1993
JP 07-121017 A 5/1995
JP 07-134486 A 5/1995
JP 09-185177 A 7/1997
JP 2001-042618 A 2/2001
JP 3349286 * 11/2002
JP 2004-029501 A 1/2004
JP 2005-258149 9/2005

OTHER PUBLICATIONS

A. Kondo; "*A Mechanism for Frictional Charging Using Powder Toner*"; Society for Electrophotography 43rd Research Symposium; pp. 26-30; (1979).

* cited by examiner

*Primary Examiner*—David M Gray
*Assistant Examiner*—Andrew V Do
(74) *Attorney, Agent, or Firm*—Edwards Angell Palmer & Dodge LLP; David G. Conlin; David A. Tucker

(57) ABSTRACT

A device for transferring toner along a flow path extending sequentially through an upstream stirring chamber(s) and a downstream stirring chamber(s). Toner transfer control apparatus controls toner transfer into the flow path, and a transfer of a developer including toner and a carrier between and from the upstream stirring chamber(s) to and between the downstream stirring chamber(s) to the latent image carrier whereby toner density along the flow path is controlled such that (i) a weight percentage of toner relative to developer in the upstream stirring chamber(s) is equal to or less than a first threshold value governing a time required to uniformly charge the toner; and (ii) the weight percentage of the toner to developer in the downstream stirring chamber(s) is greater than the first threshold value and equal to or less than a second threshold value necessary for the avoidance of uncharged toner.

7 Claims, 5 Drawing Sheets

DEVELOPING DEVICE, IMAGE FORMING APPARATUS AND DEVELOPING METHOD

This Nonprovisional application claims priority under 35 U.S.C. §119(a) on Patent Application No. 2005/180798 filed in Japan on Jun. 21, 2005, the entire contents of which are hereby incorporated by reference.

FIELD OF THE INVENTION

The present invention relates to a developing device used for (i) an image forming apparatus, (ii) an image recording apparatus and, specifically, (iii) an apparatus for transferring, onto a medium such as paper, an electrostatic latent image developed on a photoreceptor with the use of a developer. Examples of such apparatuses include an electrophotographic copier, a printer, and a facsimile machine.

BACKGROUND OF THE INVENTION

A two-component development system is provided in an image forming apparatus such as an electrophotographic copier or a printer so as to develop, with the use of a developer made up mainly of toner and magnetic particles (carrier), an electrostatic latent image formed on an image carrier. The two-component development system is widely used for a large printing machine capable of high-speed printing.

FIG. 5 shows a typical two-component developing device. According to the developing device in FIG. 5, a developer stirring chamber 80 provided in a developer tank 70 contains a two-component developer made up of nonmagnetic toner and a carrier. The nonmagnetic toner is made up mainly of a polyester resin, and the carrier is in the form of magnetic particles.

Provided in the developer stirring chamber 80 containing the aforementioned developer are: a developing sleeve 91, which is provided adjacent to a photoreceptor drum 94; a stirring screw 81, which is located directly below a toner hopper 60; and the like.

The developing sleeve 91 contains a magnet 92 made up of a plurality of magnetic poles. The developing sleeve 91 (i) regulates, with the use of a blade 93 provided near the developing sleeve 91, an amount of two-component developer to be conveyed, (ii) carries the developer layered on a surface thereof, and (iii) conveys the developer to a developing area of the developing sleeve 91 facing the photoreceptor drum 94. In the developing area, only the toner of the developer is attracted by an electric field generated by electrostatic charges on a surface of the photoreceptor drum 94, and is transferred from the developer.

Rotation of the stirring screw 81 by a rolling mechanism (not shown) (i) stirs the developer entirely in an axial direction and (ii) causes the toner to carry a desired amount of charge while causing the toner and the carrier together constituting the developer to rub against each other. When a toner density sensor 82 detects a decrease in toner density in the developer stirring chamber 80, an operation is carried out such that the toner is dropped from a toner feed opening 61 provided at a lower end of the toner hopper 60. The dropped toner is stirred into and mixed with a residual developer by the rotation of the stirring screw 81.

The toner density in the developer stirring chamber 80 is always monitored by the toner density sensor 82. When the toner density reaches a specified value, the supply of the toner from the toner feed opening 61 is stopped.

In this way, the developer stirred by the stirring screw 81 maintains a constant toner density, and the toner is caused to carry a certain amount of charge.

A developing process carried out at a higher speed requires stirring the toner and the carrier together constituting the developer in a shorter period of time. For this reason, the stirring and mixing of the developer and application of the charge in a desired amount to the toner must be carried out more quickly than in a normal process. Therefore, some sort of effort needs to be made so that the developing device can be used without problems in a high-speed developing process.

According to an electrophotography-use developer disclosed in Japanese Unexamined Patent Publication No. 102865/1992 (Tokukaihei 4-102865; published on Apr. 3, 1992), microparticles of an inorganic oxide having a specific volume resistance are added to toner and a carrier, so that (i) charge exchangeability between the toner and the carrier and (ii) a charging speed are improved. As a result, uncharged toner additionally supplied from a toner hopper into the developer is successfully inhibited from (a) becoming weakly charged and (b) becoming inversely charged, although such uncharged toner is likely to (a') become weakly charged and (b') become inversely charged. Addition of the additive to the developer instead of altering a developing process carried out in a developer tank makes it possible to be compliant with a high-speed developing process.

According to a developing device disclosed in Japanese Unexamined Patent Publication No. 333700/1993 (Tokukaihei 5-333700; published on Dec. 17, 1993), attention is paid to a toner density of toner contained in a developer, which toner density is strongly correlated with a saturated charging amount of the toner. A technique of highly accurately controlling the toner density realizes stabilization of the charging amount of the toner.

Concerning the relationship between (i) the saturated charging amount of the toner and (ii) the toner density of the toner contained in the developer, the Kondo theory advocated by Professor Kondo of the Nippon Institute of Technology is widely known. The Kondo theory corresponds to an experimental result with high reproducibility. (See Kondo, A. *A Mechanism for Frictional Charging Using Powder Toner*, "Society for Electrophotography 43rd Research Symposium", pp. 26-30 (1979))

(i) a specific charge amount of toner (value of the amount of an electric charge q relative to the mass of toner m, q/m[C/g]) and (ii) a toner covering rate θ (*2) calculated from the number of toner particles (*1) sticking to one carrier particle has a relationship expressed by the following formula:

$$q/m=(a\theta+b)^{-1}$$

*1 Number of Toner Particles Sticking to One Carrier Particle=(Number of Toner Particles Contained in Developer)/(Number of Carrier Particles Contained in Developer)

*2 Toner Covering Rate θ=(Number of Toner Particles Sticking to One Carrier Particle)×(Projected Area of One Toner Particle)/(Surface Area of One Carrier Particle)

Both *1 and *2 assume that each of the particles is a spherical particle.

Note that the constants a and b are determined depending on physical properties of the toner and the carrier, respectively. The specific charge amount of toner is inversely proportional to the toner covering rate θ, and is a value uniquely decided by the toner covering rate, i.e., by the toner density of the toner contained in the developer. Controlling the charging amount of toner to be stable is equivalent to controlling the toner covering rate to be constant, and is nothing but managing the mass of toner relative to the mass of the developer.

According to a developing device disclosed in Japanese Unexamined Patent Publication No. 172879/1989 (Tokukaihei 1-172879; published on Jul. 7, 1989), a toner replenishing roller for controlling an amount of toner to be supplied from a toner hopper is provided with a frictional charging function, so that toner charging rise-up properties obtained when the toner is supplied is improved. According to the toner replenishing roller provided with the charging function, the toner to be supplied is sandwiched between the toner replenishing roller and a metal or resin blade so as to be rubbed, and is given an electrical charge in advance. Since the toner supplied to a developer is always charged toner, no defect occurs in a developed image even if the supplied toner reaches a developing area without having been stirred into a carrier in a stirring chamber.

As described above, a developer of a two-component developing method has an arrangement such that toner and a carrier are quickly stirred and the toner carries electric charge in a desired amount. This realizes (i) improvement in toner charging rise-up performance and (ii) stabilization of the amount of an electric charge.

However, also in each of the aforementioned conventional examples, an arrangement of a developer tank designed for high-speed development has a problem described below.

As described above, according to the developing device disclosed in the aforementioned Japanese Unexamined Patent Publication (Tokukaihei 5-333700), the stabilization of the charging amount of the toner is realized by highly accurately controlling the toner density of the toner contained in the developer. Here, attention must be paid to the fact that this function is effective only in cases where the saturated charging amount of the toner is evaluated. Generally, the saturation of the charging amount of toner requires charging time that depends on the physical property of the toner. There is no problem under a process condition where a sufficient amount of charging time is secured. However, in cases where the process is carried out at a higher speed and it is therefore impossible to secure sufficient stirring time for the developing device or the like, the toner falling short of the saturated charging amount reaches a developing area, and taints a developed image.

Further, according to the developing device disclosed in the above-mentioned Japanese Unexamined Patent Publication (Tokukaihei 1-172879), the toner is rubbed between the toner replenishing roller and the metal or resin blade. In such a developing device, the problem of toner fusion with a blade cannot be avoided, as with the case of a toner layer forming blade using a one-component developing method. The toner is put under great stress when the toner is rubbed, and it impossible to guarantee long-term stability of toner charging.

When the blade is tainted due to the toner fusion, the toner to be supplied cannot be given a sufficient amount of electric charge, so that uncharged toner remains in the developer. This causes toner fogging or smudges on a sheet of paper. The problem of toner fusion appears more remarkably in case where toner designed for a high-speed developing process and made up of a soft material slightly shifted toward a low molecular weight is used. Therefore, it is necessary to take measures against the problem.

A high-end ultrahigh-speed copier (model having a copying speed of 70 or more copies per minute in monochrome copying and a copying speed of 50 or more copies per minute in color copying) recently launched on the market by each company is approaching the limit of toner charging rise-up performance. Since the stirring performance of a developer is determined depending upon respective diameters of a stirring screw and a developing sleeve, it is possible to satisfy a desired property by enlarging those components. However, since there have been strong consumer needs for a small copier, there is a limit on the maximum size of the components.

For example, assume a developing process (i) in which a developing device which outputs 70 sheets of A4-size paper per minutes in a landscape orientation is used, (ii) in which a developing sleeve has a diameter of 30 mm, and (iii) in which the developing sleeve rotates so that a surface of the developing sleeve moves 1.5 times faster than a surface of a photoreceptor body carrying an electrostatic latent image. In such a developing process, the surface of the developing sleeve has a circumferential velocity of 36.6 cm/sec, and the rotational velocity reaches 233 rpm. The increase in the rotational velocity of the developing sleeve causes a stirring screw to rotate at a higher velocity. The increase in the rotational velocity of the stirring screw causes the toner to stay in a stirring chamber for a shorter period of time. As a result, it becomes inevitable that a developer is stirred in a shorter period of time. In cases where such a stirring mechanism as described above is adopted, toner charging failure, particularly a high proportion of uncharged toner, is likely to occur under such conditions that the circumferential velocity of the surface of the developing sleeve exceeds approximately 36 cm/sec.

It is an object of the present invention to provide a developing device (i) which solves the foregoing problems caused when a two-component developer is used in a high-speed developing process, (ii) which is capable of causing uncharged toner to carry a desired amount of charge, by quickly mixing the uncharged toner with a carrier and stirring the mixture even when the uncharged toner is continuously supplied from a toner hopper, (iii) which realizes (a) further improvement in toner charging rise-up performance and (b) further stabilization of the amount of electric charge for charging, and (iv) which is always capable of developing a high-quality image.

SUMMARY OF THE INVENTION

It is an object of the present invention to provide a developing device (i) which solves the foregoing problems caused when a two-component developer is used in a high-speed developing process, (ii) which is capable of providing uncharged toner with a desired amount of charge by quickly mixing the uncharged toner with a carrier and stirring the mixture even when the uncharged toner is continuously supplied from a toner hopper, (iii) which realizes (a) further improvement in toner charging rise-up performance and (b) further stabilization of the amount of electric charge for charging, and (iv) which is always capable of developing a high-quality image.

A developing device according to the present invention is a developing device for visualizing an electrostatic latent image by using a two-component developer made up of toner and a carrier, the developing device, including: toner transfer means provided between one or more upstream side stirring chambers and one or more downstream side stirring chambers, each of the upstream side stirring chambers being provided on an upstream side of a flow of the toner which is stirred into the developer and charged in a process of transferring the toner from a toner supply section to a latent image carrier, each of the downstream side stirring chambers being provided on a downstream side of the flow, the toner transfer means controlling a toner density by transferring the toner from the upstream side stirring chamber to the downstream side stirring chamber, in order that: a weight percentage of the toner relative to the developer in the upstream side stirring chamber is equal to or less than a first threshold value governing time involved in uniformly charging the toner; and a weight percentage of the toner relative to the developer in the downstream side stirring chamber is (i) greater than the first threshold value and (ii) equal to or less than a second threshold value necessary for eliminating uncharged toner in the downstream side stirring chamber.

According to the foregoing arrangement, the toner transfer means adjusts an amount of toner that is to be poured into the downstream side stirring chamber, and controls the toner density so that the toner density in the upstream side stirring chamber is equal to or less than the first threshold value and that the weight percentage of the toner in the downstream side stirring chamber is (i) greater than the first threshold value and (ii) equal to or less than the second threshold value. The toner density and the length of charging time are proportional to each other. Therefore, by carrying out a control such that the toner density is relatively lower in the upstream side stirring chamber than in the downstream side stirring chamber, it is possible to shorten a period of time involved in causing the toner to carry a desired amount of charge. Further, by carrying out a control such that the toner density is relatively higher in the downstream side stirring chamber than in the upstream side stirring chamber, it is possible to carry out development with a high regard for the quality of an electrostatic latent image formed on a surface of a latent image carrier. As a result, it is possible to (i) realize (a) further improvement in toner charging rise-up performance and (b) further stabilization of the amount of an electric charge and (ii) always develop a high-quality image.

Note that the number of stirring chambers is not limited to two. In cases where there are three or more stirring chambers, the toner transfer means may be provided between each of the stirring chambers and the other so that the toner density gradually increases as the toner is transferred from an upstream stirring chamber to a downstream stirring chamber.

Further, in addition to the foregoing arrangement, the developing device according to the present invention may be arranged so as to further include: a first stirring chamber provided in an uppermost stream side among the upstream side stirring chambers, wherein: a weight percentage of the toner relative to the developer to be stirred in the first stirring chamber is equal to or less than 25% in terms of the following toner covering rate.

Toner Covering Rate=((Number of Toner Particles Contained in Developer)/(Number of Carrier Particles Contained in Developer))×(Projected Area of One Toner Particle)/(Surface Area of One Carrier Particle)

According to the foregoing arrangement, since the toner covering rate is equal to or less than 25%, it is possible to remarkably shorten time involved in causing uncharged toner to carry a desired amount of charge. This makes it possible to further improve toner charging rise-up performance.

A toner covering rate of 25% is a condition that a total surface area of one toner particle capable of sticking to one carrier particle is equal to the surface area of the carrier particle. That is, a stirring condition under which a toner covering rate is equal to or less than 25% refers to a condition under which the total surface area of a carrier contained in a developer which is stirred in a stirring chamber is equal to or greater than the total surface areas of toner particles contained in the developer.

As a result of carrying out an experiment to measure a distribution of charging amounts of toner particles using the toner covering rate θ as a parameter, it was found that such a remarkable improvement in charging capability to uniformly charge all the toner particles in a short period of time is a feature commonly seen in cases where the toner covering rate is equal to or less than 25%.

An experimental result that supports the numerical basis will be fully described in the "DESCRIPTION OF THE EMBODIMENTS".

A developing device according to the present invention is a developing device for visualizing an electrostatic latent image by using a two-component developer made up of toner and a carrier, the developing device, including: an upstream side stirring chamber provided on an upstream side of a flow of the toner which is stirred into the developer and charged in a process of transferring the toner from a toner supply section to a latent image carrier; a downstream side stirring chamber provided on a downstream side; and toner transfer means for controlling (i) an amount of toner to be transferred from the toner supply section to the upstream side stirring chamber and (ii) an amount of toner to be transferred from the upstream side stirring chamber to the downstream side stirring chamber, in order that a toner density in the upstream side stirring chamber is kept equal to or less than a first threshold value and that a toner density in the downstream side stirring chamber is kept (a) greater than the first threshold value and (b) equal to or less than a second threshold value.

According to the foregoing arrangement, by adjusting (i) an amount of toner to be transferred from the toner supply section to the upstream side stirring chamber and (ii) an amount of toner to be transferred from the upstream side stirring chamber to the downstream side stirring chamber, the toner transfer control means controls the toner density so that the toner density in the upstream side stirring chamber is equal to or less than the first threshold value and that the toner density in the downstream side stirring chamber is (a) greater than the first threshold value and (b) equal to or less than the second threshold value. The toner density and the length of charging time are proportional to each other. Therefore, by carrying out a control such that the toner density is relatively lower in the upstream side stirring chamber than in the downstream side stirring chamber, it is possible to shorten a period of time involved in causing the toner to carry a desired amount of charge. Further, by carrying out a control such that the toner density is relatively higher in the downstream side stirring chamber than in the upstream side stirring chamber, it is possible to carry out development with a high regard for the quality of an electrostatic latent image formed on a surface of a latent image carrier. As a result, it is possible to (i) realize (a) further improvement in toner charging rise-up performance and (b) further stabilization of the amount of an electric charge and (ii) always develop a high-quality image.

Meanwhile, a developing method according to the present invention is a developing method for visualizing an electrostatic latent image by using a two-component developer made up of toner and a carrier, the developing method, including: a toner transferring step to be carried out between an upstream side stirring step and a downstream side stirring step, which are carried out respectively on an upstream side and a downstream side of a flow of the toner which is stirred into the developer and charged in a process of transferring the toner from a toner hopper to a latent image carrier, in the toner transferring step, a toner density being controlled by transferring the toner from the upstream side stirring step to the downstream side stirring step, in order that: a weight percentage of the toner relative to the developer in the upstream side stirring step is equal to or less than a first threshold value governing time involved in uniformly charging the toner; and a weight percentage of the toner relative to the developer in the downstream side stirring step is (a) greater than the first threshold value and (b) equal to or less than a second threshold value.

As with the functions and effects explained based on the arrangement of the developing device, the foregoing arrangement has: a plurality of stirring steps having toner densities optimized for the different purposes of (1) uniformly charging toner in a short period of time and (2) developing a high-quality electrostatic latent image on a surface of a photoreceptor; and a toner transferring step for keeping a toner density constant in each of the steps. Therefore, it is possible to realize a developing device (i) which realizes (a) further improvement in toner charging rise-up performance and (b) further stabilization of the amount of an electric charge for charging and (ii) which is always capable of developing a high-quality image.

Note that the toner density in the second stirring chamber is subjected to the following two restrictions.

First restriction: Lower limit of the toner density restricted by an amount of development.

(In cases where the toner density is too low, it may be impossible to secure an amount of toner necessary for carrying out normal development.)

Second restriction: Upper limit of the toner density set for reduction of variations in charging amount.

(An increase in the toner density causes deterioration in charging rise-up properties. An amount of toner must be restricted so that a charging amount distribution of the toner falls within a specified range within a specified period of time.)

Because of the two restrictions, the upper and lower limits of the toner density may be defined as follows.

(1) The first threshold value is the lower limit of the toner density.

(However, in cases where the toner density falls short of the lower limit, an amount of toner necessary for development can be secured by so reducing a processing speed as to increase time that is to be spent on the development.)

(2) The second threshold value is the upper limit of the toner density.

(The toner density must not exceed the upper limit. This is because uncharged toner cannot be eliminated especially when the toner covering rate θ is 90%. In a normal developing process, the toner covering rate θ falls within the range of approximately 50% to 70%.

Additional objects, features, and strengths of the present invention will be made clear by the description below. Further, the advantages of the present invention will be evident from the following explanation in reference to the drawings.

BRIEF DESCRIPTION OF THE DRAWINGS

FIG. 2(*b*) is a graph showing a result of measuring a distribution of initial charging amounts of a developer having a toner covering rate θ of 23%.

FIG. 4(*b*) is a cross-sectional view schematically showing a toner transfer gate using a toner flying method using an electric field, which is shown in a second embodiment of the present invention.

DESCRIPTION OF THE EMBODIMENTS

Embodiment 1

Figure 1:
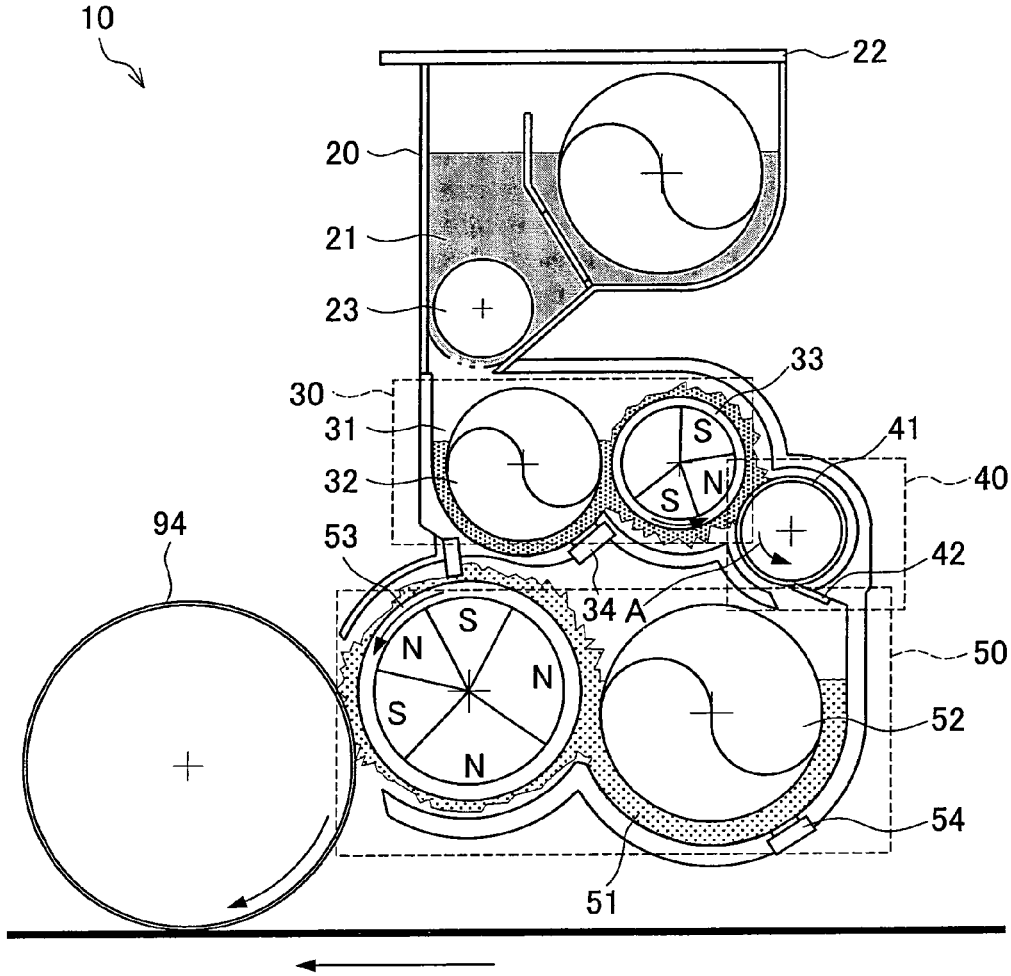
FIG. 1 is a cross-sectional view schematically showing an arrangement of a developing device according to one embodiment of the present invention.

FIG. 1 is a cross-sectional view schematically showing an arrangement of a developing device according to a first embodiment of the present invention. The present invention has a first stirring chamber 30, a second stirring chamber 50, and a toner transfer gate 40. The first stirring chamber 30 and the second stirring chamber 50 are used for stirring two-component developers having different toner densities, respectively. The toner transfer gate 40 is provided between the two stirring chambers, and works in conjunction with a toner density sensor 54 of the second stirring chamber 50. The toner transfer gate 40 is controlled so that the toner density of the first stirring chamber 30 becomes lower than a first threshold value governing time involved in uniformly charging toner 21 and that the toner density of the second stirring chamber 50 becomes (i) higher than the first threshold value and (ii) equal to or less than a second threshold value necessary for eliminating the uncharged toner 21 in the second stirring chamber 50. This allows realization of (a) toner charging rise-up properties and (b) electric charge stability both of which satisfy conditions required for a high-speed developing process.

A developer tank 10 is arranged such that: a toner retaining chamber 20, the first stirring chamber 30, and the second stirring chamber 50 are layered on top of one another.

The toner retaining chamber 20 is a toner supply section including: a toner hopper 22, which contains only the toner 21 of a developer; and a toner supply roller 23, which carries out such a control that the toner is supplied from the toner hopper 22 to a lower layer of the developer tank 10.

The first stirring chamber 30 is an upstream side stirring chamber provided in an upstream side of a flow of the toner 21 that is stirred into the developer and charged in a process of transferring the toner 21 from the toner retaining chamber 20 to a photoreceptor drum 94. The first stirring chamber 30 includes: a stirring screw 32; and a magnetic sleeve 33, which is made up of (i) an inner cylinder retaining magnetic poles and (ii) an outer cylinder that rotates. The first stirring chamber 30 contains a two-component developer 31 made up of the toner 21 and a carrier. Provided on a dividing wall located near the stirring screw 32 is a toner density sensor 34 for monitoring the toner density in the first stirring chamber.

A toner density sensor is a type of magnetic sensor, and has a characteristic of outputting a voltage value corresponding to an amount of magnetic powder contained in a developer. Generally, in cases where the density of a carrier contained in a developer increases, the magnetic flux density per unit volume increases in the vicinity of the sensor. On the other hand, in cases where an amount of toner contained in the developer increases, the carrier density per unit area decreases in the vicinity of the sensor. Accordingly, the magnetic flux density also decreases. Since the sensor is an element that outputs a voltage corresponding to the size of the magnetic flux, the toner density of the toner contained in the developer can be obtained from the voltage output value of the sensor.

The second stirring chamber 50 provided in the lower layer is a downstream side stirring chamber provided in a downstream side of the flow of the toner 21 contained in the developer tank 20. As with the first stirring chamber 30, the second stirring chamber 50 includes: a stirring screw 52; and a magnetic sleeve 53, which is made up of (i) an inner cylinder retaining magnetic poles and (ii) an outer cylinder that rotates. The second stirring chamber 50 contains a two-component developer 51 made up of the toner 21 and the carrier. Provided in a dividing wall located near the stirring screw 52 is the toner density sensor 54 for monitoring the toner density in the second stirring chamber.

Provided between the first stirring chamber 30 and the second stirring chamber 50 is the toner transfer gate 40 that works in conjunction with the toner density sensor 54 of the second stirring chamber 50. The toner transfer gate 40 includes: a toner offset drum 41, which includes a metal drum whose surface is coated with a resin thin film; and a peeling blade 42, which is provided so that a tip of the peeling blade 42 comes into contact with the toner offset drum 41. The peeling blade 42 is suitably made of a urethane rubber material so as not to destroy the resin layer applied to the surface of the toner offset drum 41.

Note that the toner transfer gate 40 corresponds to toner transfer means provided between the first stirring chamber 30 and the second stirring chamber 50 respectively provided in the upstream and downstream sides of the flow of the toner 21 which is stirred into the developer and charged in the process of transferring the toner from the toner retaining chamber 20, serving as the toner supply section, to the photoreceptor drum 94, serving as a latent image carrier.

Figure 4:
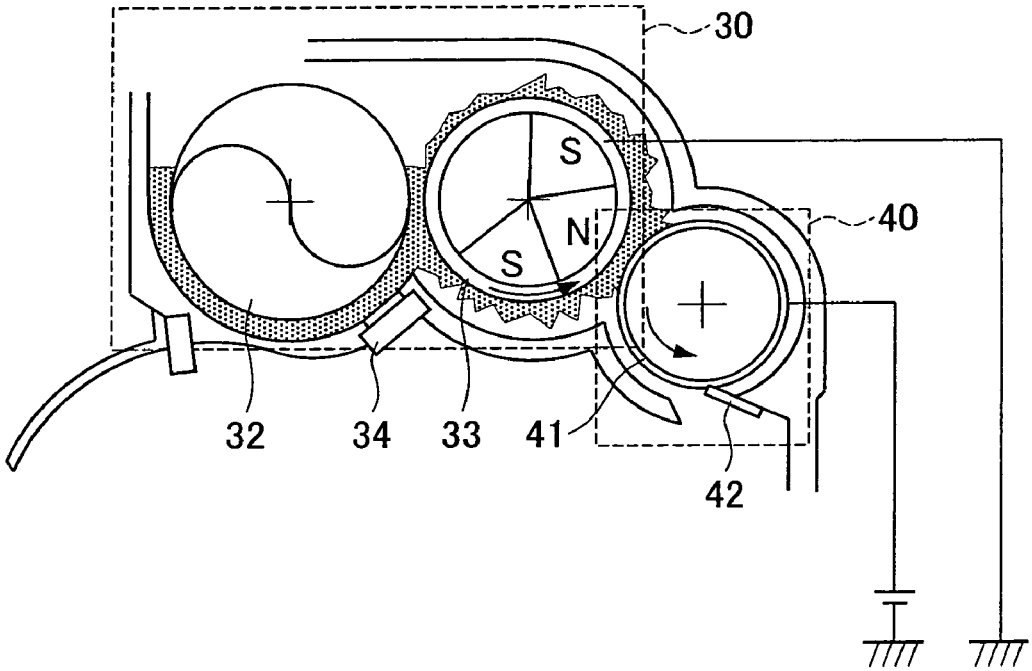
FIG. 4(*a*) is a cross-sectional view schematically showing a toner transfer gate using a blade peeling method, which is shown in a first embodiment of the present invention.
Figure 4:
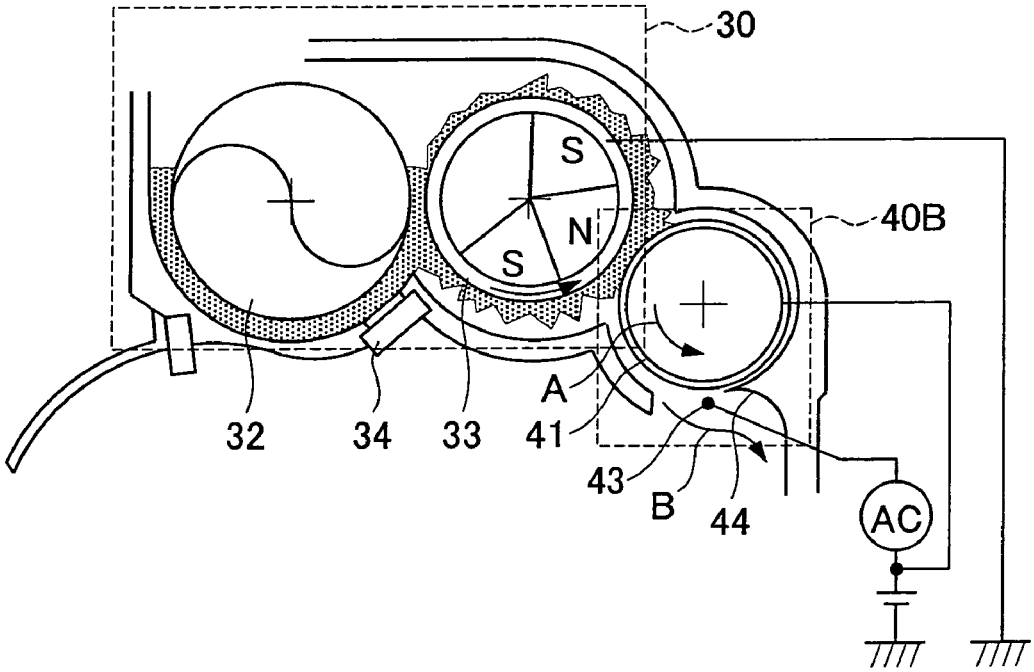
Figure 5:
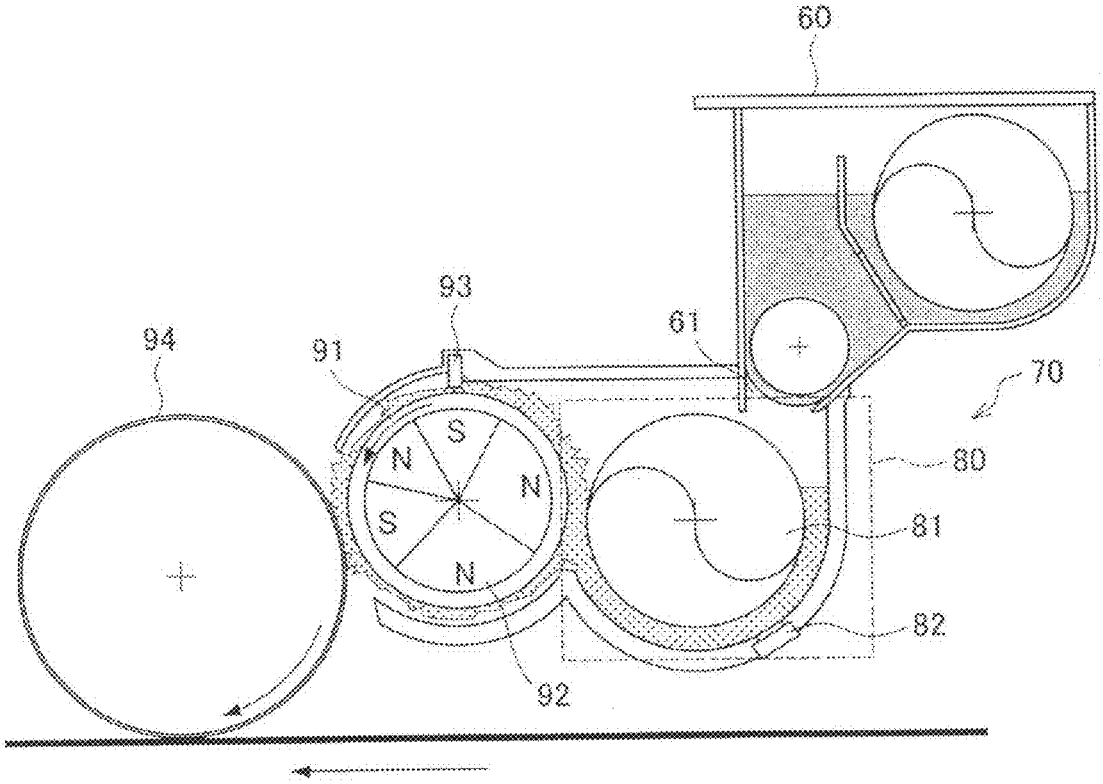
FIG. 5 PRIOR ART
FIG. 5 is a cross-sectional view schematically showing an arrangement of a developing device used for a general two-component developing method.

See the toner offset drum 41 and the magnetic sleeve 33 of the first stirring chamber 30. As shown in FIG. 4(*a*), the toner offset drum 41 is connected to a DC power source and the magnetic sleeve 33 is grounded so that a potential of the toner offset drum 41 becomes higher than a potential of the magnetic sleeve 33 and, more specifically, that the potential of the toner offset drum 41 becomes positive. When the potential of the toner offset drum 41 becomes higher than the potential of the magnetic sleeve 33 by +200 V or more, only the toner 21 of the developer conveyed on a surface of the magnetic sleeve 33 can be transferred to the toner offset drum 41 by using electrostatic attraction.

A state in which the toner transfer gate 40 is functioning refers to a state in which a process is continuously carried out in accordance with a rotational movement A of the toner offset drum 41 continuously causes the process of rubbing the toner transferred to the toner offset drum 41 by voltage application by the peeling blade 42 so as to drop the toner into the second stirring chamber 50 which is directly below the toner offset drum 41.

Each of the two-component developers 31 and 51 is made up of (i) negatively-charged pulverized toner which is made up mainly of a polyester resin and which has a particle diameter of 6.5 μm and (ii) a magnetic powder carrier which has a particle diameter of 35 μm and includes a Mn—Mg magnetic ferrite carrier core material of which surface is coated with a silicon resin thin film.

The toner density of the two-component developer 31 contained in the first stirring chamber 30 is controlled so that the aforementioned toner covering rate θ is 23%, and the toner density of the two-component developer 51 contained in the second stirring chamber 50 is controlled so that the toner covering rate θ is 60%. The toner density of the first stirring chamber 30 is a value decided so that all the supplied toner is charged quickly and uniformly, and the toner density of the second stirring chamber 50 is a value decided so that a high-quality image is developed from an electrostatic latent image formed on a surface of the photoreceptor drum 94.

According to the control of the respective toner densities of the developers, the toner densities are respectively monitored by using the toner density sensors 34 and 54, and respective flows of the two-component developers 31 and 51 are adjusted as described below. This allows the toner densities to be kept constant.

Figure 3:
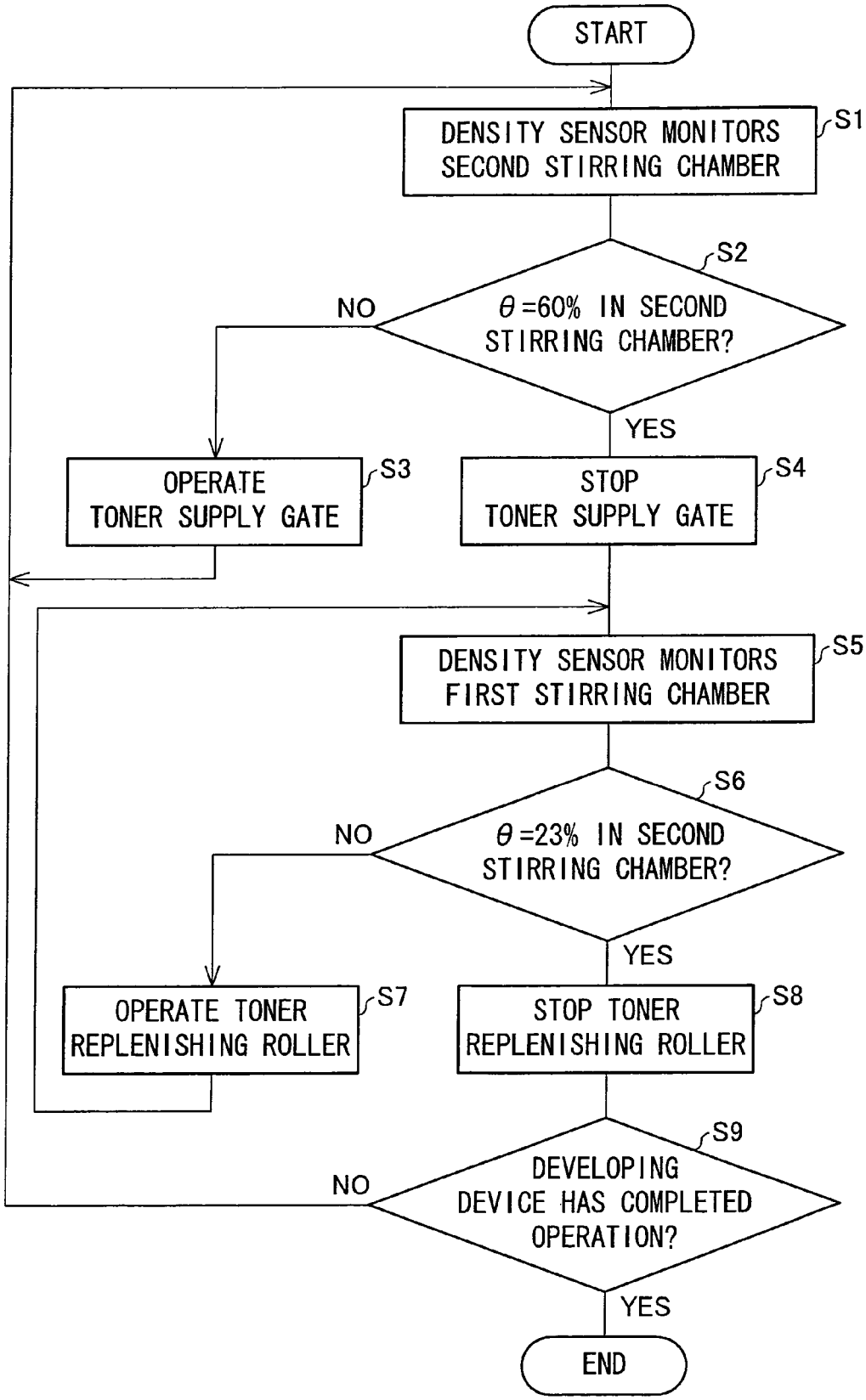
FIG. 3 is a flow chart showing a procedure for controlling a toner density of a developer in the developing device.

FIG. 3 is a flow chart showing a flow of the control of the respective toner densities of the two-component developers 31 and 51 of the developing device of the present embodiment.

In a developing area, only the toner 21 of the two-component developer 51 is transferred from the magnetic sleeve 53 to the photoreceptor drum 94 in accordance with an image to be developed, and is consumed. The toner density sensor 54 of the second stirring sensor 50 monitors the toner density in the two-component developer 51 of the second stirring chamber 50, in order that the toner covering rate θ of 60% (second threshold value) is maintained (Step 1; hereinafter abbreviated as "S1").

In cases where it is determined that the toner density in the second stirring chamber 50 has decreased due to the toner consumption (S2), a developing process control section (not shown) activates the toner transfer gate 40 (S3). Then, the toner 21 charged in the first stirring chamber 30 is sequentially supplied to the second stirring chamber 50. On this occasion, the toner density control process returns from S3 to S1. When it is determined that the supply of the toner 21 from the first stirring chamber 30 has caused the toner density in the second stirring chamber 50 to reach the specified value (S2), the toner transfer gate 40 stops (S4).

Similarly, the toner density sensor 34 of the first stirring sensor 30 monitors the toner density in the two-component developer 31 of the first stirring chamber 30, in order that the toner covering rate θ of 23% (first threshold value; first threshold value<second threshold value) is maintained (S5).

In cases where it is determined that the toner density in the first stirring chamber 30 has decreased due to the toner consumption (S6), the developing process control section (not shown) activates the toner supply roller 23 so that the toner 21 is supplied from the toner hopper 22 to the first stirring chamber 30. On this occasion, the toner density control process returns from S7 to S5.

When it is determined that the supply of the toner 21 has caused the toner density in the first stirring chamber 30 to reach the specified value (S6), the toner supply roller 23 stops (S8).

The above control sequence allows the toner density of each of the stirring chambers 30 and 50 to be kept constant. According to the foregoing description, the process concerning the toner density in the second stirring chamber 50 is carried out first, and then the process concerning the toner density of the first stirring chamber 30 is carried out. However, the present invention is not limited to this. For example, the two processes may be carried out in a reverse order or at the same time.

As described above, the toner transfer gate 40 transfers the toner 21 from the first stirring chamber 30 to the second stirring chamber 50 so that: the weight percentage of the toner 21 relative to the developer in the first stirring chamber 30 is equal to or less than the first threshold value necessary for the toner 21 to be uniformly charged in a short period of time; and the weight percentage of the toner 21 relative to the developer in the second stirring chamber 50 is greater than the first threshold value and is equal to or less than the second threshold value necessary for preventing the uncharged toner 21 from being left in the second stirring chamber 50. In this way, the toner transfer gate 40 functions as toner transfer means for controlling a toner density. On this occasion, the toner density must not exceed the second threshold value. This is because uncharged toner cannot be eliminated especially when the toner covering rate θ is 90%. In a normal developing process, the toner covering rate θ falls within the range of approximately 50% to 70%.

In view of the toner density controlling function of the toner transfer means, the toner transfer means can include the developing process control section, the toner density sensor 34, and the toner density sensor 54.

Further, the toner supply roller 23, the toner transfer gate 40, the toner density sensor 34, and the toner density sensor 54 function as toner transfer control means. The toner transfer control means controls (i) an amount of toner to be transferred from the toner retaining chamber 20 to the first stirring chamber 30 and (ii) an amount of toner to be transferred from the first stirring chamber 30 to the second stirring chamber 50, in order that the toner density of the first stirring chamber 30 is kept equal to or less than the first threshold value and that the toner density of the second stirring chamber 50 is kept (a) greater than the first threshold value and (b) equal to or less than the second threshold value.

Note that the toner transfer control means may include the developing process control section.

As described above, the developing device according to the present embodiment is provided with the first stirring chamber 30 in which the toner covering rate θ is equal to or less than 25%. With this arrangement, a developing device using a two-component developer made up of toner and a carrier, allows for highly uniform charging to toner particles contained in the developer in a period of time much shorter than a period of time involved in uniformly charging toner in a conventional technique, without uncharged toner particles remained. This makes it possible to develop a high-quality image.

Embodiment 2

A second embodiment of the present invention will be described. As shown in FIG. 4, the present embodiment differs from the first embodiment in that the toner transfer gate 40 of the first embodiment is replaced by a toner transfer gate 40B. More specifically, the toner transfer gate 40B for transferring the toner 21 to the second stirring chamber 50 guides the toner 21 on the toner offset drum 41 to the second stirring chamber 50 in such a manner that less stress is applied to the toner 21 as compared with a manner in the first embodiment.

FIG. 4(*b*) shows an arrangement of the toner transfer gate 40B partially different from the toner transfer gate 40 in the first embodiment.

The toner transfer gate 40B that works in conjunction with the toner density sensor 54 of the second stirring chamber 50 includes: the toner offset drum 41, which includes a metal drum whose surface is coated with a resin thin film; and a toner flying wire electrode 43, which to provide in a tensioned state in parallel with an axis of the toner offset drum 41 so as not to come into contact with the toner offset drum 41. The toner flying wire electrode 43 is a metal wire rod of which a core is covered with insulating coating, and has a diameter of 150 μm. The toner flying wire electrode 43 is provided at a distance of 500 μm from a surface of the toner offset drum 41. Further, a rectifying fin 44 is provided in a downstream with respect to the toner flying wire electrode 43 in the flow of the toner 21 transferred by a rotational movement A of the toner offset drum 41. The rectifying fin 44 effectively transfers the flying toner 21 into the second stirring chamber 50.

An operation mechanism of the toner transfer gate 40B shown in FIG. 4(*b*) will be described.

When the potential of the toner offset drum 41 becomes higher than the potential of the magnetic sleeve 33 by +200 V or more, only toner particles contained in the two-component developer 31 conveyed on a surface of the magnetic sleeve 33 can be transferred to the toner offset drum 41 by electrostatic attraction. Due to the rotational movement A of the toner offset drum 41, the surface of the toner offset drum 41 having the toner 21 sticking thereto reaches a position that is directly above the toner flying wire electrode 43.

Applied to the toner flying wire electrode 43 is a voltage including a DC voltage and an AC voltage superimposed on the DC voltage, and the AC voltage generates an alternate field. Due to the alternate field, the toner particles conveyed directly above the toner flying wire electrode 43 move back and forth between the toner offset drum 41 and the toner flying wire electrode 43.

The rotational movement A of the toner offset drum 41 causes air current surrounding the toner offset drum 41 to flow along the shape of the toner offset drum 41. However, the rectifying fin 44 provided behind the toner flying wire electrode 43 causes most of the air current B flowing along the toner offset drum 41 to go directly down to the second stirring chamber 50. As a result, most of the flying toner 21 is guided to the second stirring chamber 50, and is mixed with the two-component developer 51 contained in the second stirring chamber 50.

Unlike the first embodiment, the developer tank 10 having the toner transfer gate 40B makes it possible to supply toner to the second stirring chamber 50 without rubbing the toner offset drum 41 of the toner transfer gate 40B. Therefore, a developer tank can be realized which causes less mechanical damage to toner particles and carrier particles and which prevents deterioration of a developer over a long period of time. Needless to say, the provision of the first stirring chamber 30 and the second stirring chamber 50 brings about the same effects as in the first embodiment.

As described above, according to the developing device of the second embodiment, even when uncharged toner is continuously supplied from the toner hopper 22, a good charging property of the toner 21 can be maintained by the developing process which minimizes damage to the toner 21. This allows an ultrahigh-speed developing device to (i) inhibit an occurrence of charging failure and (ii) develop an extremely high-quality image.

[Numerical Basis for a Toner Covering Rate]

A toner covering rate of 25% is a condition that a total surface area of one toner particle capable of sticking to one carrier particle is equal to the surface area of the carrier particle. That is, a stirring condition under which a toner covering rate is equal to or less than 25% refers to a condition under which the total surface area of a carrier contained in a developer which is stirred in a stirring chamber is equal to or greater than the total surface areas of toner particles contained in the developer.

The following shows an experimental result by which the numerical basis is supported.

20 g of a sample in which toner and a carrier are mixed so that the toner covering rate is 60% and 20 g of a sample in which the toner and the carrier are mixed so that the toner covering rate is 23% were prepared. Each of the samples was encapsulated in a polyethylene container, and a charging experiment was carried out by using an arm-waving-type shaking mixer. The method using the arm-waving-type shaking mixer is a standard charging method defined by the Imaging Society of Japan, and is fully described in a reference ("Charge Measurement Procedure for Electrophotographic Toner", *Imaging Society of Japan*, Vol. 37, pp. 461-470 (1998))

Figure 2:
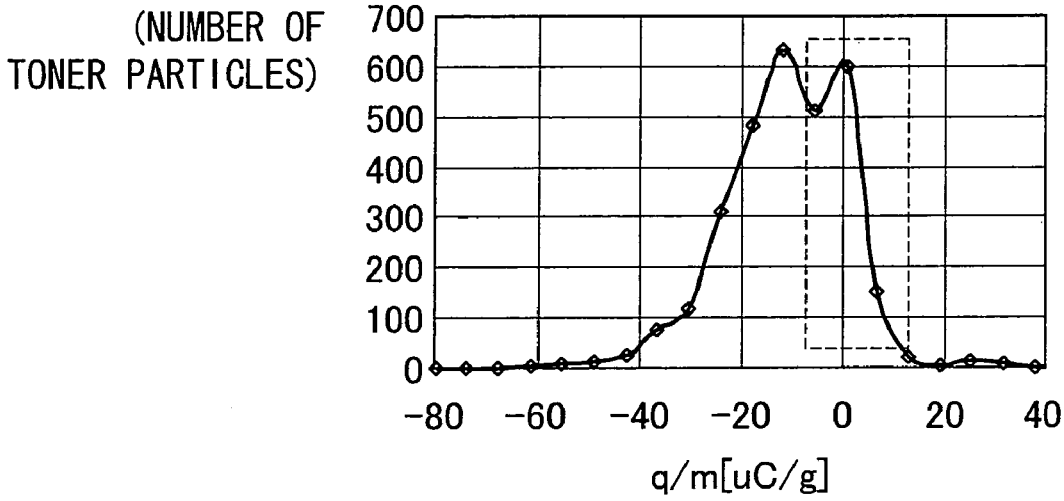
FIG. 2(*a*) is a graph showing a result of measuring a distribution of initial charging amounts of a developer having a toner covering rate θ of 60%.
Figure 2:
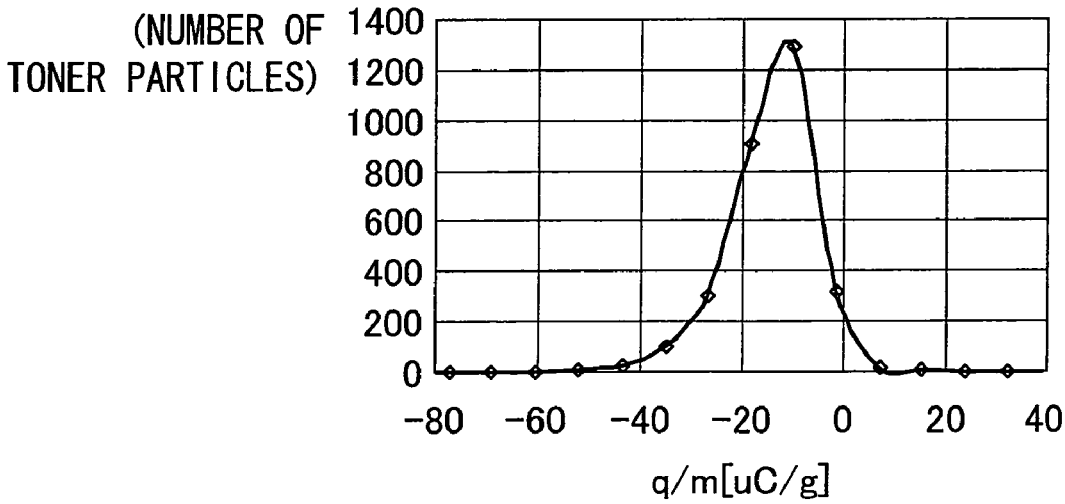

FIGS. 2(*a*) and 2(*b*) are graphs showing results of measuring, by using an charging amount distribution measuring apparatus (E-SPART charging amount distribution measuring apparatus manufactured by Hosokawamicron Corporation), charging amounts of toner particles charged for 10 minutes with the use of the arm-waving-type shaking mixer according to the charge measurement procedure for electrophotographic toner. The horizontal axis of each of the figures represents a specific charge amount of toner (=q/m), and the vertical axis represents the number of particles.

Specific Charge Amount of Toner=(Charging Amount of Toner)/(Mass of Toner)

FIG. 2(*a*) shows a result obtained when the toner covering rate θ is 60%, and FIG. 2(*b*) is a result obtained when the toner covering rate θ is 23%. A comparison between the two results shows that all the toner particles are uniformly charged in a shorter period of time in the developer having the toner covering rate θ of 23% than in the developer having the toner covering rate θ of 60%. As a result of the experiment using the toner covering rate θ as a parameter, such a remarkable improvement in charging capability is a feature commonly seen in cases where the toner covering rate is equal to or less than 25%.

The present invention is not limited to the description of the embodiments above, but may be altered by a skilled person within the scope of the claims. An embodiment based on a proper combination of technical means disclosed in different embodiments is encompassed in the technical scope of the present invention.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. A developing device for visualizing an electrostatic latent image by using a two-component developer made up of toner and a carrier, the developing device, comprising:

toner transfer means respectively provided between each of one or more upstream side developer stirring chambers and each of one or more downstream side developer stirring chambers, each upstream side developer stirring chamber being provided on an upstream side of a toner transfer means such that toner input into said one or more upstream side developer stirring chambers is stirred into the developer and charged in a process of transferring said input toner from a toner supply section to a latent image carrier, each of the downstream side stirring chambers being provided on a downstream side of a toner transfer means, wherein said respective toner transfer means control a toner density in the developer contained in said upstream and downstream side developer stirring chambers respectively adjacent thereto by transferring only toner from said upstream side developer stirring chamber to said downstream side developer stirring chamber, in order that:

a weight percentage of the toner relative to the developer in said upstream side developer stirring chamber is equal to or less than a first threshold value governing time involved in uniformly charging the toner; and a weight percentage of the toner relative to the developer in said downstream side developer stirring chamber is (i) greater than the first threshold value and (ii) equal to or less than a second threshold value necessary for eliminating uncharged toner in said downstream side developer stirring chamber.

2. The developing device as set forth in claim 1, further comprising:

a first developer stirring chamber provided on an uppermost stream side among the upstream side developer stirring chambers, wherein: a weight percentage of the toner relative to the developer to be stirred in the first developer stirring chamber is equal to or less than 25% in terms of the following toner covering rate:

Toner Covering Rate=((Number of Toner Particles Contained in Developer)/(Number of Carrier Particles Contained in Developer))×(Projected Area of One Toner Particle)/(Surface Area of One Carrier Particle)

3. An image forming apparatus, comprising:

the developing device as set forth in claim 2.

4. An image forming apparatus, comprising:

the developing device as set forth in claim 1.

5. A developing device for visualizing an electrostatic latent image by using a two-component developer made up of toner and a carrier, the developing device, comprising:

an upstream side developer stirring chamber provided on an upstream side of a toner transfer means for transferring only toner; and a downstream side developer stirring chamber provided on a downstream side of said toner transfer means for transferring only toner such that developer in said upstream side and downstream side stirring chambers respectively is stirred and input toner is charged in a process of transferring the input toner from a toner supply section into and through said developing device to a latent image carrier;

said developing device further comprising toner transfer control means for controlling (i) an amount of toner input from said toner supply section into the upstream side developer stirring chamber and (ii) an amount of said only toner transferred by said toner transfer means from the upstream side developer stirring chamber into the downstream side developer stirring chamber, in order that a toner density in the upstream side developer stirring chamber is kept equal to or less than a first threshold value and that a toner density in the downstream side developer stirring chamber is kept (a) greater than the first threshold value and (b) equal to or less than a second threshold value.

6. An image forming apparatus, comprising:

the developing device as set forth in claim 5.

7. A developing method for visualizing an electrostatic latent image by using a two-component developer made up of toner and a carrier, the developing method, comprising:

a toner only transferring step carried out between an upstream side developer stirring step and a downstream side developer stirring step, which stirring steps are carried out respectively on an upstream side and a downstream side of said only toner transferring step such that input toner from a toner supply section is stirred into the developer and charged in a process of transferring the input toner from said toner supply section to a latent image carrier, and said only toner transferring step being such that a toner density is controlled by transferring said only toner from the upstream side stirring step to the downstream side stirring step via the only toner transferring step, in order that: a weight percentage of the toner relative to the developer in the upstream side developer stirring step is made equal to or less than a first threshold value governing time involved in uniformly charging the toner in a short period of time; and a weight percentage of the toner relative to the developer in the downstream side developer stirring step is made (a) greater than the first threshold value and (b) equal to or less than a second threshold value.

* * * * *